United States Patent [19]

Arnett

[11] 4,222,308

[45] Sep. 16, 1980

[54] ACCURACY DEVICE FOR SEMI-AUTOMATIC PISTOLS

[76] Inventor: Perry J. Arnett, 97 S. 100 East, Parowan, Utah 84761

[21] Appl. No.: 23,582

[22] Filed: Mar. 26, 1979

[51] Int. Cl.[3] ..... F41C 5/06

[52] U.S. Cl. ..... 89/163

[58] Field of Search ..... 89/163, 195, 196

[56] References Cited

U.S. PATENT DOCUMENTS 3,411,404 11/1968 Pachmayr et al. ..... 89/163

*Primary Examiner*—Stephen C. Bentley

*Attorney, Agent, or Firm*—Criddle & Western

[57] ABSTRACT

The accuracy of a semi-automatic piston of the locked breech type is improved by tapering each side of the tenon at the rear of the barrel and correspondingly tapering the tenon engaging recess in the slide, thereby assuring that the rear of the barrel is accurately centered at the breech face of the slide and is prevented from moving laterally. The mating surface of the under-barrel lug is contoured such that when the barrel is in battery the slide stop pin bears against the under-barrel lug in such a manner as to cause the barrel to be jam fitted between the slide stop pin and the underside, top surface of the slide thereby preventing any vertical movement.

10 Claims, 8 Drawing Figures

ACCURACY DEVICE FOR SEMI-AUTOMATIC PISTOLS

BACKGROUND OF THE INVENTION

This invention relates to means for enhancing the accuracy of a semi automatic pistol of the locked breech type without impairing, or otherwise hindering the functional reliablilty of the weapon. More particularly, this invention relates to means for more accurately engaging the rear portion of the barrel of a semi automatic pistol into the slide and preventing lateral and vertical movement therein.

The accuracy of locked breech type semi automatic pistols, such as the Colt Government Model 45 ACP, is dependant upon the ability of the barrel to be held in exactly the same position in the slide after each firing. In such firearms the frame, sometimes referred to as the receiver, remains stationary relative to the barrel and the slide. The barrel pivots downward and backward about a pivotal link connected to the frame for a limited distance upon the firing of a round. At the same time the slide moves backwardly along the frame, becoming disengaged from locking lugs in the barrel, and continuing its rearward movement sufficiently far to eject the spent cartridge and cock the firing mechnism before returning forward under spring pressure and loading a new cartridge into the firing chamber of the barrel.

Several factors contribute to the accuracy of such a firearm. Obviously the accuracy of the bore with its riflings is important as is the cartridge itself. However, these are parameters which are not affected by the fitting together of the parts within the pistol. There are critical fit dimensions which affect firearm accuracy. These all relate to the slide and barrel since the barrel is more intimately associated with the slide than the frame. Moreover the front and rear sights of the pistol are mounted in the slide and serve as the overall datum of accuracy of the pistol. It follows therefore that the fit of the barrel in the slide will, to a large extent, be determinitive of the accuracy of the pistol. More importantly, the reproducibility of the fit after each firing cycle is determinitive of the guns inherant accuracy potential.

There are several misconceptions regarding just what is required to assure accuracy in a semi automatic pistol of the locked breech type. The following axioms are offered as factors affecting the accuracy of such weapons.

1. the line of sight is the basic accuracy datum and not the frame,
2. the barrel must point to the same place as the sights however the frame does not have to;
3. lateral and vertical positioning of the rear of the barrel in the slide must be uniform from shot to shot;
4. the barrel can be positioned no higher than the interior surface of the slide will allow;
5. the muzzle of the barrel must be held concentrically in the slide from shot to shot;
6. the under-barrel lug serves only to provide uniform longitudinal positioning of the barrel with reference to the slide stop pin as the weapon is presently constituted;
7. the grip frame serves only to provide a handle, enclose the firing mechanism and provide a fixed location in space for the slide stop pin (the fit of the slide and frame rails is of no conseqeuence).
8. the barrel link serves only to unlock the barrel from the slide.

OBJECTS OF THE INVENTION

It is an object of the present invention to provide a semi automatic pistol of the breech block type with means to enhance its accuracy.

It is also an object of the present invention to provide a double tapered barrel tenon which fits with a compatibly configured double tapered slide mortice thereby securing the rear of the barrel against lateral displacement and insuring that the lateral fit of the barrel in the slide is secure and without variation from shot to shot.

Another object of the present invention is to provide an arcuate contoured under-barrel lug which, when cooperating with the slide stop pin, prevents vertical displacement of the rear portion of the barrel when in battery and insures that the barrel remains in the same position from shot to shot.

A still further object of the invention is to provide a means for securing the rear of the barrel in the slide against lateral and vertical displacement when in battery while at the same time allowing unrestricted movement of the barrel within the slide when in counter recoil.

These and other objects are accomplished by (1) uniformly tapering the barrel hood or tenon on each side thereof and providing the sides of the corresponding tenon recess in the slide with the same taper and (2) contouring the under-barrel lug and oversizing the connecting link aperture such that the under-barrel lug rides upon the slide stop pin in such a manner that the barrel is forced both upwardly and forwardly in the slide and held therein in a jam fit position when the barrel is in battery. The lateral width of the tenon recess is slightly smaller than the tenon thereby assuring contact between the tenon and the tenon recess walls and preventing lateral movement of the rear portion of the barrel when the tenon is engaged in the tenon recess. Similarly the barrel is jam fitted between the slide stop pin and the top underside of the slide and is thus prevented from longitudinal and vertical displacement when the weapon is in battery. However, when in counterbattery the barrel is free to pivot downward and backward about the pivotal link connected to the frame.

DRAWINGS

DESCRIPTION OF THE INVENTION

Figure 1:
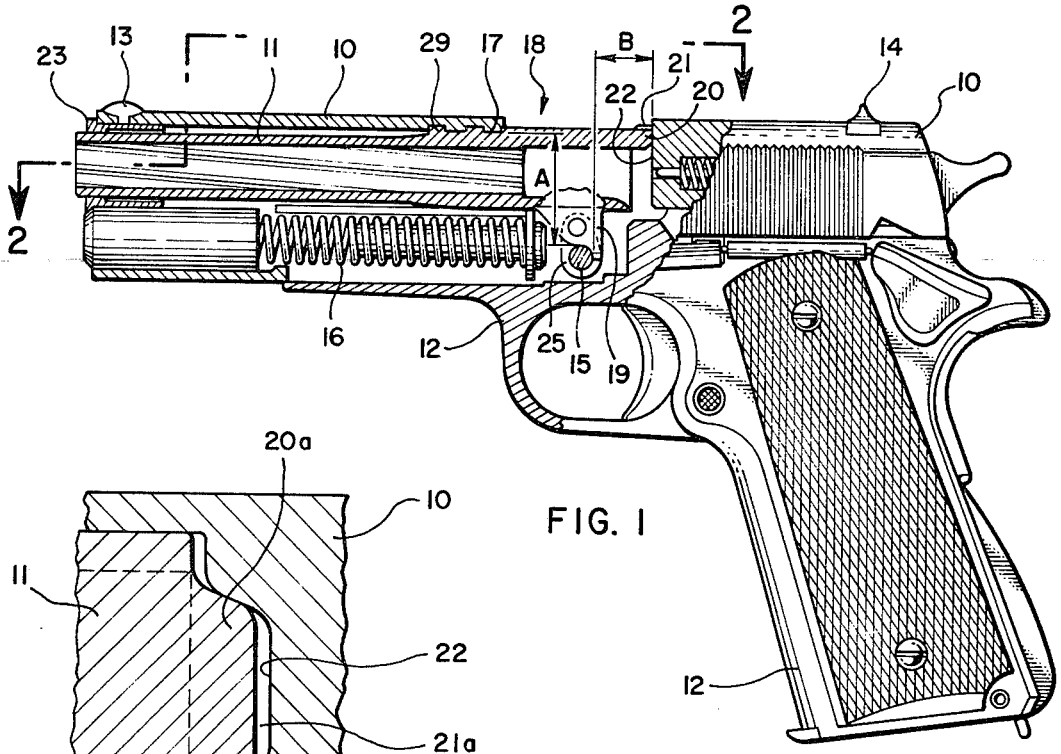
FIG. 1 is a side view of a typical semi-automatic pistol partially broken away to show the barrel, slide, under-barrel lug, connecting link and slide stop pin.

There is shown in FIGS. 1-8 a complete operative embodiment of the invention. In order to maintain the accuracy of a semi-automatic pistol from shot to shot it is imperative that the moving parts, such as the slide and barrel, cooperate in such a manner that the critical fit between the parts is maintained and function as if the moving parts were a single unit. The slide 10 generally encompasses and holds the barrel 11. However, both slide and barrel are anchored to and move about the frame 12. The accuracy of the pistol is a function of the alignment of the bore of barrel 11 with the line of sight established by aligning the target to be fired at with front sight 13 and rear sight 14 mounted in slide 10. The alignment of the bore of the barrel 11 can be maintained relative to sights 13 and 14 only if the barrel can be critically fitted within slide 10 and restrained from any movement therein until the projectile from a fired cartridge has left the barrel. Any change or variation in either the lateral or vertical positioning of the barrel within the slide will obviously affect accuracy.

Since the slide and barrel must move relative to each other it follows that there must be slidable metal to metal contact during recoil and loading resulting in the return of the barrel and slide to the same exact position shot after shot.

One of the critical dimensions affects the vertical alignment of the barrel within the slide. From FIG. 1 it can be seen that if the vertical distance from the top of slide stop pin 15 to the upper center contour of the inner surface of the slide 17 just forward of the ejection port 18 is equal to the vertical distance from the bottom contour of under-barrel lug 19 to the top of the barrel where it meshes with the slide just forward of the ejection port 18 there can be no vertical movement of the rear portion of the barrel 11 when the barrel 11 and slide 10 are in their forward or firing positions. This distance is designated by the letter A in FIG. 1. However, it can also be seen from FIG. 1 that the slide stop pin 15 and the contour of the mating surface of the under-barrel lug 19 are based on a circle of the same diameter. Therefore, the under-barrel lug is configured to bear uniformly against the entirety of an upper side quadrant of the slide stop pin 19, when in battery. This engagement causes the barrel 11 to be forced forward against the slide stop pin. Because contact is maintained by the under-barrel lug against a point on the slide stop pin which is most rearward and which is on a line parallel to the horizontal axis of the barrel through the center of the slide stop pin, it can be observed that all force imparted by the recoil spring 16 to the barrel is forwrdly directed. Hence, if the initial fit of the underbarrel lug, the slide stop pin and the slide is such that any looseness exists when the weapon is in battery there is an inherent inaccuracy in the weapon which will always exist.

Figure 2:
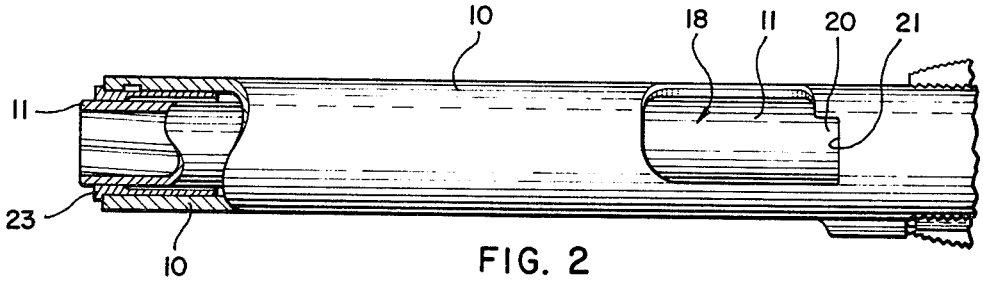
FIG. 2 is a top view of a prior art semi-automatic pistol showing the barrel tenon engaged in the tenon recess of the slide.

Present means for laterally securing the barrel within the slide involves interfacing the tenon or hood 20 at the rear of the barrel in a corresponding mortise or tenon recess 21 in the slide as shown in FIG. 2. The tenon 20 projects backwardly from the top of the barrel 11 with the sides of the tenon being parallel with the longitudinal plane of the barrel. The usual practice with regard to the critical fit of the tenon within the tenon recess 21 in the slide is to build the tenon 20 wider than the width of the tenon recess 21 and then to lap the tenon into the recess to obtain as tight a fit as possible while allowing sufficient tolerance for the tenon to slide into and out of the tenon recess. Since the sides of the tenon are parallel, getting a proper fit without affecting accuracy is difficult. If a tight jam fit is obtained between the barrel tenon and the tenon recess the barrel may be held in complete alignment but will bind because of the tight interface and will not freely function in and out of the recess. On the other hand, if the tolerance between the tenon side wall and the tenon recess wall is sufficient to allow free function of the tenon in and out of the recess, a degree of lateral movement will be possible and the tenon will not be seated in the tenon recess in exactly the same location from shot to shot. Therefore a certain inherent inaccuracy is built into every barrel and slide combination intermeshed as described.

Longitudinal movement of the barrel within the slide is presently prevented by sizing the barrel such that the distance from the forward contoured surface of under-barrel lug 19 to the rear of barrel hood or tenon 20 is the same as the distance from the rear face of slide stop pin 15 to the slide breech face 22 when the slide is in its forward position. This is designated by the letter B in FIG. 1.

The forward end of the barrel is held in position by the barrel bushing 23. The outside diameter of the front portion of the barrel and the inside diameter of the barrel bushing are machined within carefully defined tolerances to allow passage of the barrel through the bushing upon recoil and loading operations but to permit no lateral or vertical movement of the barrel when the slide and barrel are in battery position. The Colt Series 70 Mark IV, in both Gold Cup and Government Models, offers an accurizing device wherein the forward end of the barrel and its corresponding spring collet "accurizor" bushing are tapered and mated to further reduce any error that might occur with the standard barrel and bushing.

Figure 5:
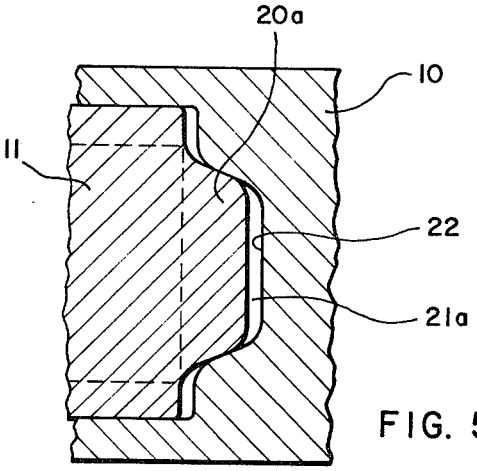
FIG. 5 is an enlarged partial top view of the tenon and tenon recess showing the fit of the tenon in the tenon recess taken along lines 5—5 of FIG. 4.
Figure 3:
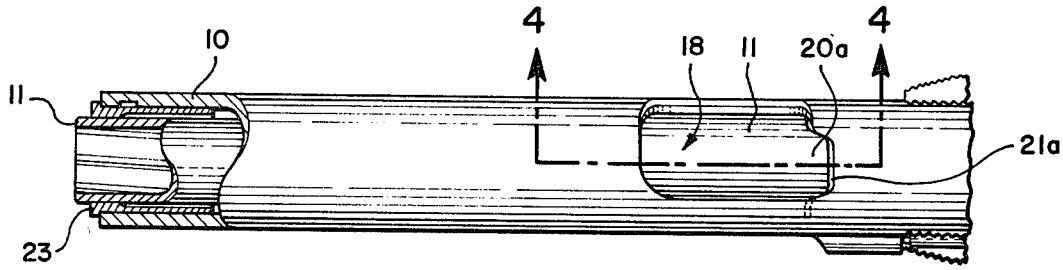
FIG. 3 is a top view similar to FIG. 2 modified to show a tapered barrel tenon and tenon recess in the slide.
Figure 4:
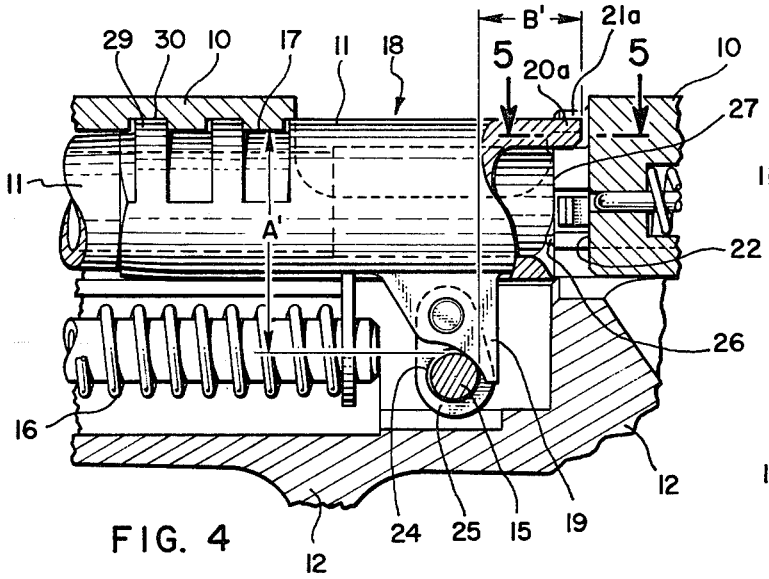
FIG. 4 is an enlarged fragmentary side view of a portion of a semi-automatic pistol taken along lines 4—4 of FIG. 3 showing the relative positions of the barrel and slide in battery position according to the present invention.
Figure 7:
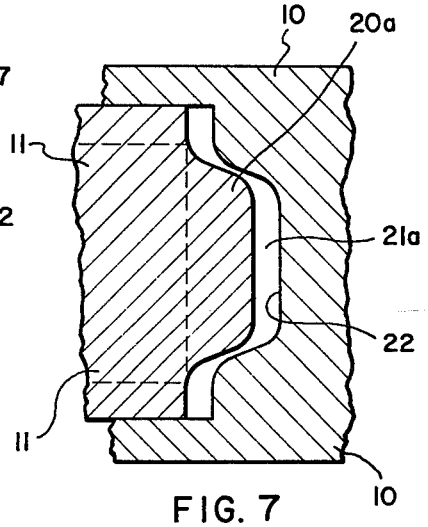
FIG. 7 is an enlarged partial view similar to FIG. 5 taken along lines 7—7 of FIG. 6 showing the relative gap between the tenon and tenon recess as the slide and barrel move forward until the rear of the barrel is fully elevated.
Figure 6:
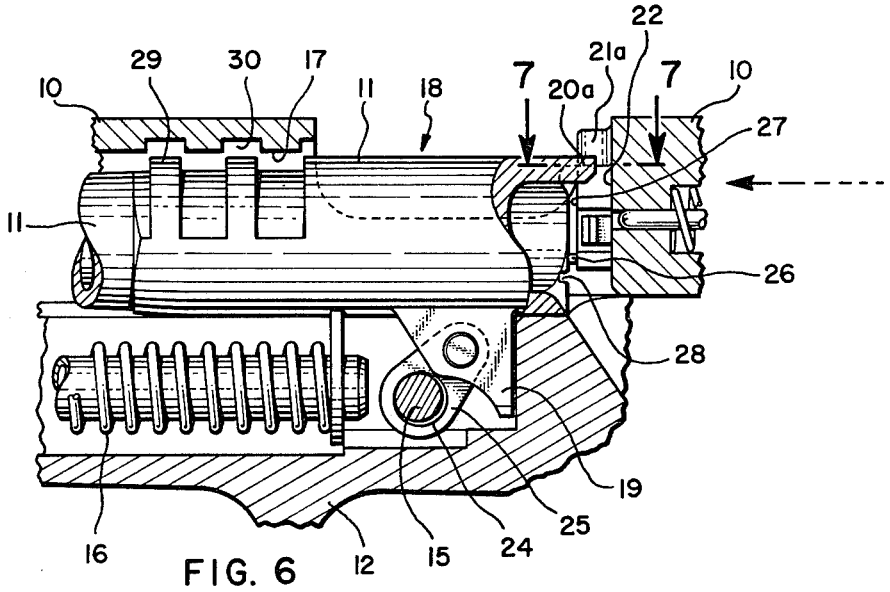
FIG. 6 is a fragmentary side view similar to FIG. 4 showing the relative position of the barrel and slide at the point in time the slide first contacts the rear of the barrel to move the barrel into battery.

The present invention prevents lateral movement of the rear portion of the barrel within the slide by tapering the tenon **20*a* as shown in FIGS. 3, 5 and 7 and prevents vertical movement of the rear of the barrel by modifying the under-barrel lug 19 as shown in FIGS. 4 and 6** to cause upward as well as forward pressure on the barrel when in battery.

With reference to FIGS. 3, 5 and 7, the tenon **20*a* is tapered on each side with a uniform taper. The angle of taper is measured relative to a plane parallel with the longitudinal axis of the barrel. The angle may vary from about 15 to 45 degrees with a 20 to 30 degree angle being preferred. A taper of about 9.6 inches per lineal foot or about 22 degrees, is considered optimum. Preferably the tenon 20*a* is the same shape as the tenon recess and is preferably machined to be slightly wider i.e. about 0.010 to 0.060 of an inch so that the tenon 20*a* becomes firmly engaged in the tenon recess 21*a*** before the rear of the tenon reaches the end of the tenon recess. The gap between the end of the tapered tenon and the tenon recess will be on the order of 0.010 to 0.050 of an inch. Thus the rearward movement of the tapered tenon 20*a* into the tenon recess 21*a* automatically centers the rear portion of the barrel in the slide. Due to the taper of the tenon recess the barrel will be repositioned in exactly the same location in the slide each time the pistol is fired without interferring with the free functioning of the slide and barrel during recoil and loading.

Figure 8:
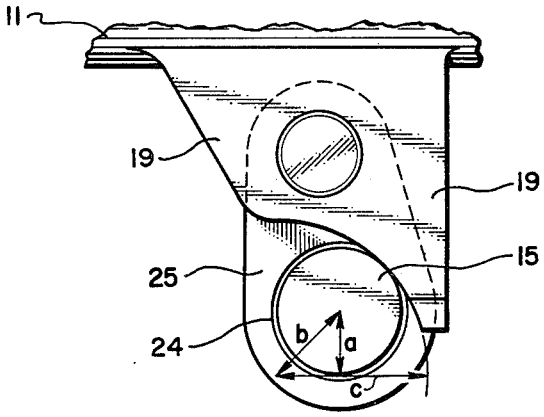
FIG. 8 is an expanded view of under-barrel lug, connecting barrel link and slide stop pin according to the present invention.

Vertical movement or displacement is prevented in the present invention by causing the contoured or arcuate portion of the under-barrel lug 19 to bear against the slide stop pin 15 at a single reference point which is approximately equidistant on the periphery of the perimeter of the slide stop pin 15 between the horizontal and vertical quadrant lines as shown in FIG. 8. Assuming the conventional system of noting degrees beginning with a horizontal diameter line and rotating counter clockwise around a circle the single reference point would be at 45° on both the slide stop pin 15 and the arcuate under-barrel lug surface. The arcuate contour of the under-barrel lug 19 represents a portion of the circumference of a circle larger in diameter than the diameter of the slide stop pin 15. Preferably the arcuate contour of the under-barrel lug as shown in FIG. 8 represents a circle whose radius "c" is the sum of the radius "a" of the slide stop pin plus the hypotenuse "b" of a right triangle having both sides of the same length as the radius "a"of the slide stop pin. Stated another way the radius "c" is determined by the length of a line extending through the slide stop pin at 45° angle from two intersecting lines tangential to the circumference of slide stop pin 15 which are at right angles to each other. Radius "c" extends from the point of intersection of the tangential lines to the circumference of the slide stop pin on the opposite side. Mathematically stated:

$$c=a+b$$

$$b=\sqrt{a^2+a^2}$$

$$c=a+a^2+a^2$$

$$c=a+\sqrt{2a^2}$$

$$c=a+1.4142136\,a$$

From the above, taken with FIG. 8, it may be seen that slide stop pin 15 is located entirely in the upper right quadrant (0–90°) of a circle partially represented by the arcuate contour under-barrel lug 19. From this description it can be seen that any forwardly directed recoil spring force against the barrel toward the slide stop pin 15 will be forwardly and upwardly directed with a vector force at 135° (45° forward of vertical) through the center axis of the slide stop pin. The obvious result is that the barrel 11 by contouring the under-barrel lug 19 and causing the contact of the slide stop pin 15 and under-barrel lug as explained, will always be in a tight, jam fit between the slide stop pin 15 and the underside surface of the slide 17 when in battery. This is represented by the letter A in FIG. 7. This tight fit will exist only when the slide 10 and barrel 11 are in battery and the unlocking sequence upon recoil will proceed as normal with the tight fit being broken upon the vary initial beginning of the unlocking sequence. In order to allow the upward jam fit of the barrel the slide stop pin aperture 24 located in connecting link 25 will be milled to be slightly larger in diameter than slide stop pin 15. In general the diameter of the slide stop pin aperture 24 will be about 0.030 to 0.070 inches and preferably about 0.050 inches larger than the slide stop pin.

Although these parts can be fitted loosely initially they will automatically return to a tight fit in the same exact position in battery shot after shot.

It is evident from the above that lateral and vertical movement or displacement of the barrel in the slide in battery is prevented by the tapering of the tenon and tenon recess and by modifying the contour of the under-barrel lug.

The longitudinal fit of the barrel within the slide is still governed by the critical dimension designated by letter B in FIG. 1. However the tenon under-barrel lug will be modified as described such that the distance represented by B in FIG. 4 will be governed by the fit of the tapered tenon 20*a* into the tenon recess 21*a* and the positioning of the under-barrel lug 19 relative to the slide stop pin. The fit of the tenon 20*a* into the tenon recess 21*a* requires that the barrel tenon mate with the walls of the tenon recess in a longitudinal coupling movement. The barrel pivots upwardly and forwardly about the slide stop pin 15 via connecting link 25. To prevent binding between the tenon and walls of the tenon recess it is essential that the barrel be pivoted to its highest point before the tenon 20*a* and tenon recess 21*a* walls become engaged. This may be accomplished by providing means, such as shoulder 26 which contacts the rear portion of the barrel 11 as the slide 10 moves forward under pressure from recoil spring 16. The shoulder 26 protrudes from a first shoulder 27 laterally located in the slide just forward of the breech face 22 opposite from the extractor and prevents the barrel tenon 20*a* from engaging in the tenon recess 21*a* of the slide as shown in FIG. 7 until the barrel has reached a fully forward position. When the barrel becomes fully elevated the shoulder 26 slips into barrel recess 28 having a depth greater than the length of the shoulder and the tapered barrel tenon becomes firmly engaged in the tenon recess securing the barrel against lateral movement. Means functionally similar to shoulder 26 may be substituted in its stead. For example a spring loaded ball of lesser spring tension than recoil spring 16 could be positioned in the slide. The ball would contact the barrel until the barrel became fully elevated at which time the spring would compress under pressure between the barrel and the slide and the ball would retract into the slide. Whatever means are used must be of sufficient magnitude of projection to maintain a gap of from 0.005 to 0.025 inches between the tenon walls and tenon recess walls until the barrel is fully elevated.

The longitudinal fit of the locking lugs 29 of the barrel into the corresponding recesses 30 in the slide is not necessary to achieve accuracy as commonly believed. In operating a pistol according to the present invention, the slide shoulder 26 fully elevates the barrel and the barrel and slide then comes into battery by the barrel tenon becoming engaged in the tenon recess in the slide. The barrel rests upwardly about its pivot point so that the contour of barrel lug 18 rests on slide stop pin 15 as described and the top of the barrel seeks the upper center contour 17 of the interior of the top of the slide. In this position the barrel 11 is held in a uniform fixed position which will not vary from shot to shot by the critical fits caused by (a) the tapered barrel tenon being jammed in the tenon recess preventing lateral movement, (b) the barrel beig firmly engaged between the top of slide stop pin 15 and the inner top surface of the slide 17 preventing vertical movement, (c) the barrel being firmly held against longitudinal movement between the slide stop pin 15 and the tenon 20*a* engaged in tenon recess 21*a* and, (d) the barrel bushing 23 firmly engaging the front of the barrel and holding it in a concentric position. These are the only fits which must be maintained in order to assure accuracy of the pistol from shot to shot.

The above description shows that the barrel will be engaged in the slide in exactly the same position in-battery shot after shot. Thus, if the sights are accurately aligned with the barrel, maximum accuracy will be attained. It may be observed, however, that if any battering, wearing away or other changing of the contour of either the stop pin or the under-barrel lug occurs, this changing of contour will cause the barrel lug to shift upwardly on its contour against the slide stop pin. Theoretically this could affect the vertical alignment of the barrel. However, such change is not anticipated to amount to more than a maximum of 0.010 inches over a course of 10,000 rounds. Even so, since the entire thrust of this invention is accuracy, any weapon incorporating it is presumed to contain adjustable sights. Thus, small shifts in position occurring after the firing of thousands of rounds can easily be compensated for. What is important is that constant and accurate vertical and lateral positioning of the rear of the barrel in the slide from shot to shot can be maintained by this invention.

While this description constitutes the best mode presently known of making and carrying out the invention, modifications may be made without departing from this invention which is to be limited only by the appended claims.

I claim:

1. In a semi-automatic pistol of the locked-breech type having, (a) a frame, (b) a barrel containing a tenon projecting from the rear upper portion thereof and a contoured under-barrel lug projecting downwardly from the rear portion thereof, (c) a connecting link attached to the under-barrel lug pivotally connecting the barrel to the frame by means of a slide stop pin which passes through the frame and an aperture in the lower portion of the connecting link and (d) a slide slidably engaged on said frame said slide encompassing said barrel and having a top undersurface adapted to engage the top of the barrel and a tenon recess adapted to engage the barrel tenon when the barrel and slide are in battery;

the improvement comprising, (e) a barrel wherein the sides of the barrel tenon taper inwardly and backwardly and wherein the under-barrel lug is contoured with an arcuate contour which represents a portion of a circle having a diameter larger than the diameter of the slide stop pin (f) a connecting link having an aperture in the lower portion thereof having a diameter slightly larger than the diameter of the slide stop pin (g) a slide having a tenon recess whose sides are tapered inwardly at the same angle as the sides of the barrel tenon; wherein the tenon recess has a lateral width slightly smaller than the lateral width of the barrel tenon and (h) means in the slide to fully elevate the barrel during the recoil and loading cycle of the pistol prior to the tenon becoming engaged in the tenon recess wherein, the frame, barrel, connecting link and slide cooperate in such a manner that when in battery the tenon is jam fitted into the walls of the tenon recess in the slide preventing lateral movement of the tenon and the barrel is jam fitted with the upper surface of the barrel engaging the top undersurface of the slide and the contour of the under-barrel lug resting on the slide stop pin in such a manner as to exert an upward and forward force on the barrel preventing vertical movement of the rear portion of the barrel.

2. The improvement according to claim 1 wherein the sides of the tenon and tenon recess are tapered at an angle of between about 15 and 45 degrees from a plane parallel to the longitudinal axis of the barrel.

3. The improvement according to claim 2 wherein the diameter of the aperture in the connecting link is 0.030 to 0.070 inches greater than the diameter of the slide stop pin.

4. The improvement according to claim 3 wherein the arcuate contour of the under-barrel lug engages the periphery of the slide stop pin in the upper rear quadrant of the slide stop pin.

5. The improvement according to claim 4 wherein the arcuate contour of the under-barrel lug represents a portion of the circumference of a circle having a radius of ($a=1.4142136a$) wherein "a" is the radius of the slide stop pin.

6. The improvement according to claim 5 wherein the tenon is 0.010 to 0.060 inches wider than the width of the tenon recess.

7. The improvement according to claim 6 wherein the means in the slide serving to elevate the barrel during the recoil and loading cycle protrudes forwardly from a shoulder in the slide wall such as to engage the rear portion of the barrel until it is fully elevated.

8. The improvement according to claim 7 wherein the means in the slide protrudes forwardly a distance sufficiently far to cause the tenon walls to be separated from the walls of the tenon recess a distance of about 0.005 to 0.025 inches until the barrel is fully elevated.

9. The improvement according to claim 2 wherein the angle of taper of the tenon and tenon recess walls is between about 20 and 30 degrees.

10. The improvement according to claim 9 wherein the angle of taper of the tenon and tenon recess walls is about 22 degrees.

* * * * *